US005201159A

United States Patent [19]

Göranson et al.

[11] Patent Number: 5,201,159

[45] Date of Patent: Apr. 13, 1993

[54] CONSTRUCTION ELEMENT

[75] Inventors: Per Göranson; Dag Göranson; Örjan Göranson, all of Falkenberg/Sweden, Sweden

[73] Assignee: Silentia AB, Falkenberg/Swenden, Sweden

[21] Appl. No.: 678,952

[22] PCT Filed: Aug. 17, 1990

[86] PCT No.: PCT/SE90/00536

§ 371 Date: Apr. 18, 1991

§ 102(e) Date: Apr. 18, 1991

[87] PCT Pub. No.: WO91/02863

PCT Pub. Date: Mar. 7, 1991

[30] Foreign Application Priority Data

Aug. 18, 1989 [SE] Sweden ..... 8902771
Nov. 8, 1989 [SE] Sweden ..... 8903734

[51] Int. Cl.[5] ..... E04C 3/00

[52] U.S. Cl. ..... 52/580; 52/593; 52/572

[58] Field of Search ..... 52/732, 731, 580, 284, 52/300, 421, 422, 424, 436, 503, 505, 563, 564, 568, 569, 570, 571, 572, 574, 108, 604, 593

[56] References Cited

U.S. PATENT DOCUMENTS 3,619,965 11/1971 Thibert ..... 52/580
3,765,135 10/1973 Gerhardt ..... 52/593 X
4,186,539 2/1980 Harmon et al. ..... 52/580

*Primary Examiner*—David A. Scherbel
*Assistant Examiner*—Creighton Smith
*Attorney, Agent, or Firm*—Antonelli, Terry, Stout & Kraus

[57] ABSTRACT

The present invention relates to a structural element for realizing continuous surfaces, for example a screen, a partition wall, a hoarding or the like, essentially for screening-off from noise, view, etc., each corner (5, 6, 7, 8) of a substantially quadrilateral, hollow profile (1–8) being reversed and directed in towards the center of the profile (1–8), and at least one side (1) of the profile (1–8) indented because of corner reversal, being provided, at each edge, with an outwardly directed flange (9, 10), the flanges (9, 10) being parallel with one another and fitting over the sides, indented because of corner reversal, of another substantially identical profile (1–8).

3 Claims, 5 Drawing Sheets

CONSTRUCTION ELEMENT

BACKGROUND OF THE INVENTION

The present invention relates to a structural element for providing continuous surfaces, for example a screen, a partition wall, a hoarding or the like, essentially for screening-off noise, a view, etc.

Prior art elements for the erection of continuous surfaces such as walls and the like, are expensive to produce. Furthermore, the erection proper of, for example, hoardings and walls is expensive and, above all, prior art elements do not permit a many-faceted design, by which is meant versatility of variations in both the vertical and horizontal directions. This is a major requirement, since the more environmental considerations arise, the greater will be the demand that such continuous surfaces can merge in as discrete a manner as possible into the existing environment without reducing the desired effect of possible screening-off. Hence, an unconditional requirement is that the structural element permit adaptation of building works into the appearance of the landscape both vertically and horizontally.

The task forming the basis of the present invention is to provide an apparatus for obviating the drawbacks of prior art designs, or at least for reducing such drawbacks, while making possible every consideration to be taken of environmental aspects.

SUMMARY OF THE INVENTION

The major advantages afforded by an apparatus according to the present invention primarily reside in the extraordinarily versatile possibilities for variations in shape, height, colour, different disposition patterns, surface structures, transparency, translucency etc. Moreover, all of these advantages will be attained by means of a profile structural element which is simple from the point of view of manufacture and assembly or erection and which may be open or closed. By suitable design of the element, it can moreover be employed in noise barrier arrangements and noise reduction arrangements, the desired noise reduction being, int. al. achieved in that the joints are always tight. Furthermore, desired sound reduction and sound absorption are made possible, together with sufficient standing rigidity to satisfy applicable norms and standards without, to this end, needing to waive road safety requirement aspects in the form of yieldability, absence of loose parts, avoidance of fire risk, etc. Possible sound reduction (noise reduction) is optimized in that the structural element according to the present invention is given tubular design and construction which, as a result of the double-walling, imparts a higher reduction ratio. By the possibility of selecting different types of plastic materials, there will further be realized resistance to heat, cold (brittleness, risk of cracking on ice formation), colour fastness, UV light resistance, mechanical strength (impact test), resistance to exhaust gases, oil, road salt, resistance to snow-ploughing, high pressure washing, vandalism in the form of graffiti, blows and dismantling, and resistance to the effects of plants and animals. Furthermore, good possibilities exist for repair, as well as resistance to rot.

As a result of the versatility of the apparatus according to the present invention, aesthetic requirements will also be satisfied in that the arrangement may be effected in such a manner as to melt into the environment in terms of both form and colour. In this context, form is taken to mean variations in both the vertical and horizontal directions. A structural element according to the present invention also affords low running and maintenance costs. In addition, the structural element according to the invention is rational and economical to manufacture and simple to assemble, and offers great possibilities for use within many different areas, for example the element may possibly be filled with different materials such as cell-forming foamed plastic for providing buoyant bodies and the like.

BRIEF DESCRIPTION OF THE DRAWINGS

The present invention will now be described in greater detail hereinbelow with particular reference to the accompanying drawings.

DETAILED DESCRIPTION OF PREFERRED EMBODIMENTS

All embodiments have a hollow profile with substantially uniformly thick walls. However, it should be observed that the profile need not be closed, but may be open and, thereby, substantially U-shaped. Furthermore, the profile may advantageously be extruded in a suitable plastic material, for example PVC or polythylene.

Figure 1:
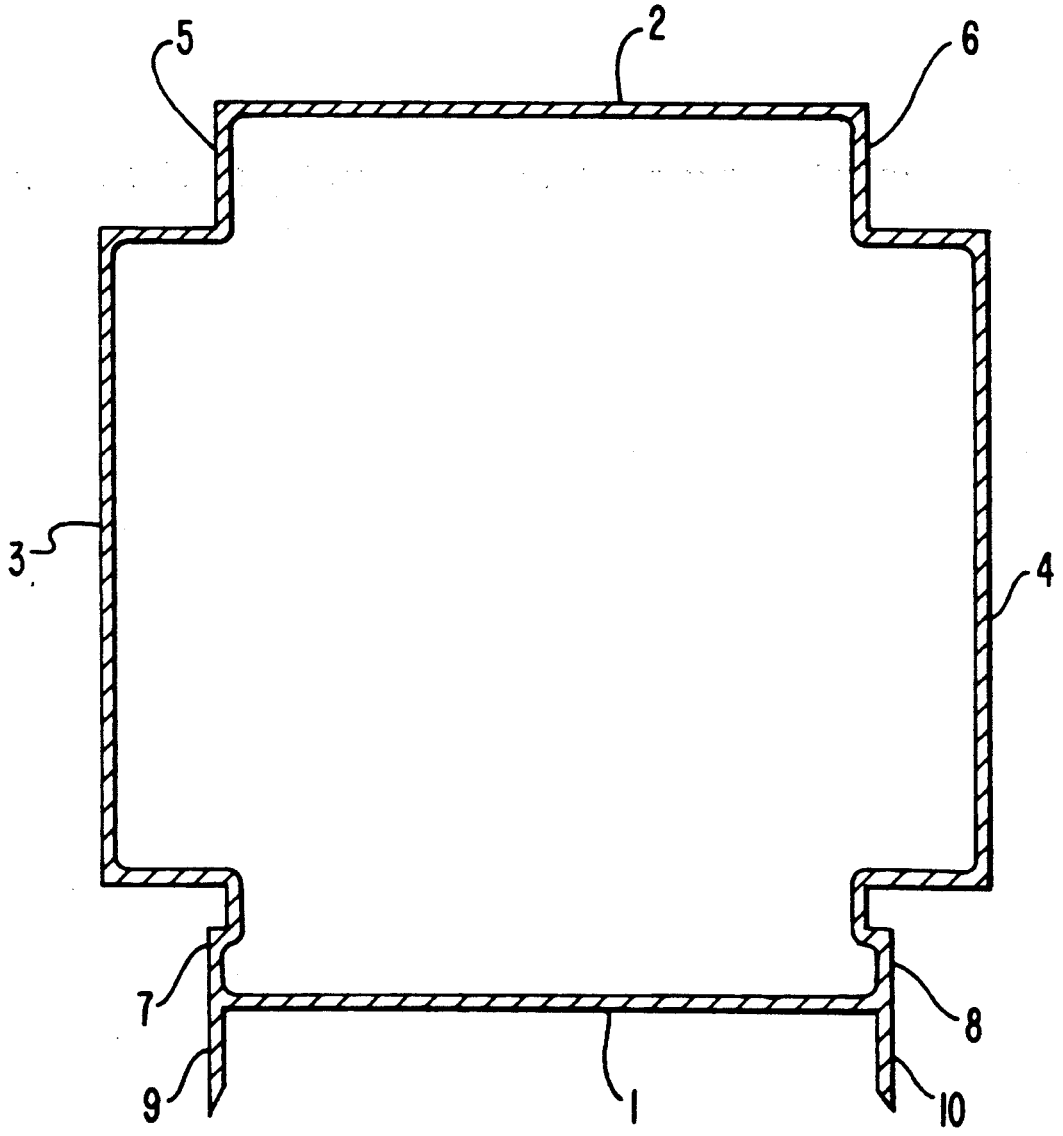
FIG. 1 shows a cross-section through a structural element according to one embodiment of the present invention.
Figure 4:
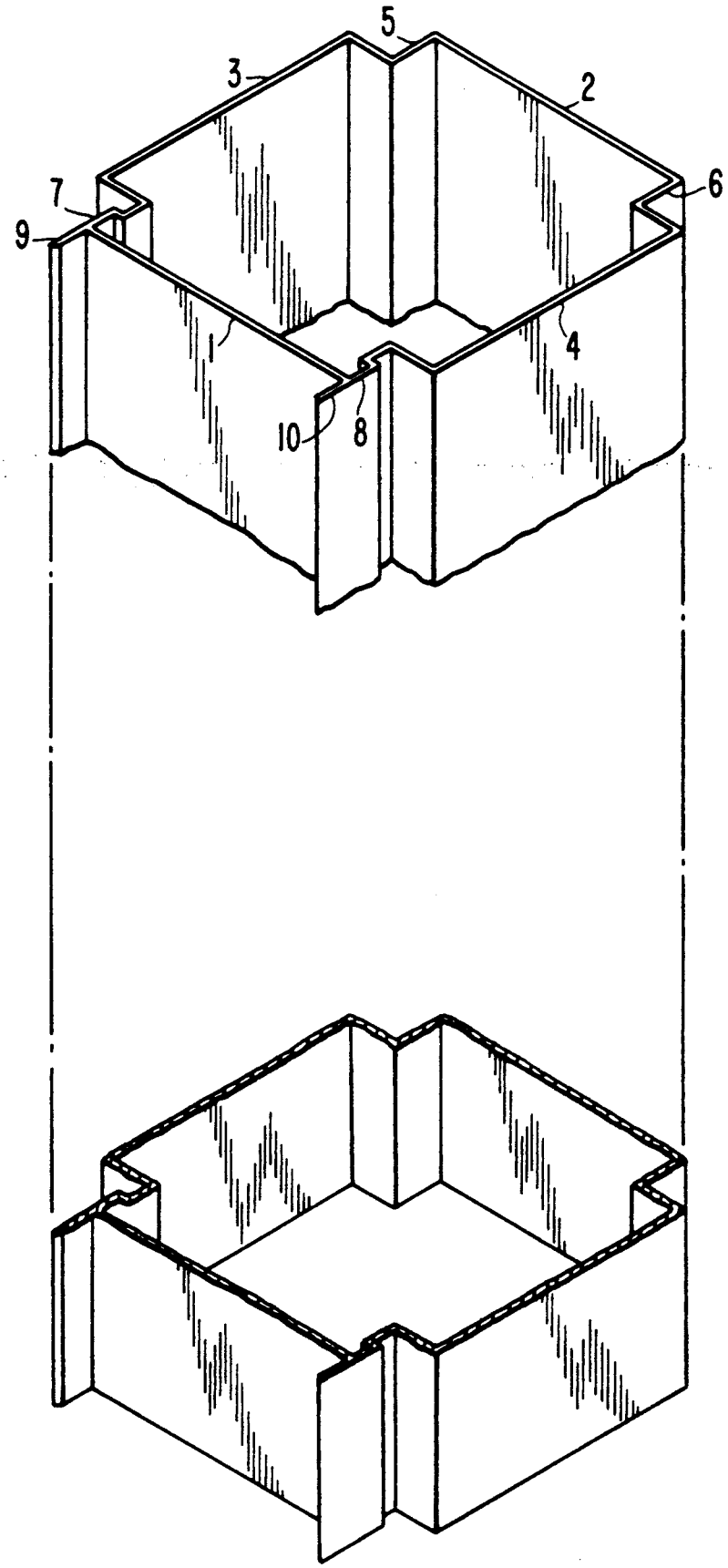
FIG. 4 shows a perspective view of a structural element according to the present invention.

As is apparent from FIG. 1 and FIG. 4, the profile is substantially quadrilateral and has two opposing sides or surfaces 1 and 2, and two opposing sides or surfaces 3 and 4 at right angles thereto. The two corners 5 and 6 disposed on either side of the surface 2 are reversed, being indented into the profile and directed in towards its central longitudinal axis. The two corners 7 and 8 on either side of the surface or side 1 are also reversed, being indented into the profile and directed in towards the interior of the profile in a direction towards its central longitudinal axis.

At each edge of the side or surface 1, there is disposed a flange 9, 10. The flanges 9 and 10 extend transversely of the plane of the surface or side 1 and are of lesser length than the depth of the corners 5–8.

In the case that the profile or structural element according to the present invention is open, parts of or the whole of the side 1 will be dispensed with. If so desired, rigidifying flanges can be provided on the inside of all surfaces or sides 1–4. While the profile or structural element shown on the Drawings has uniformly thick walls, there is, naturally, nothing to prevent the provision of suitable thicker material portions for reasons of production engineering or mechanical strength.

Figure 2:
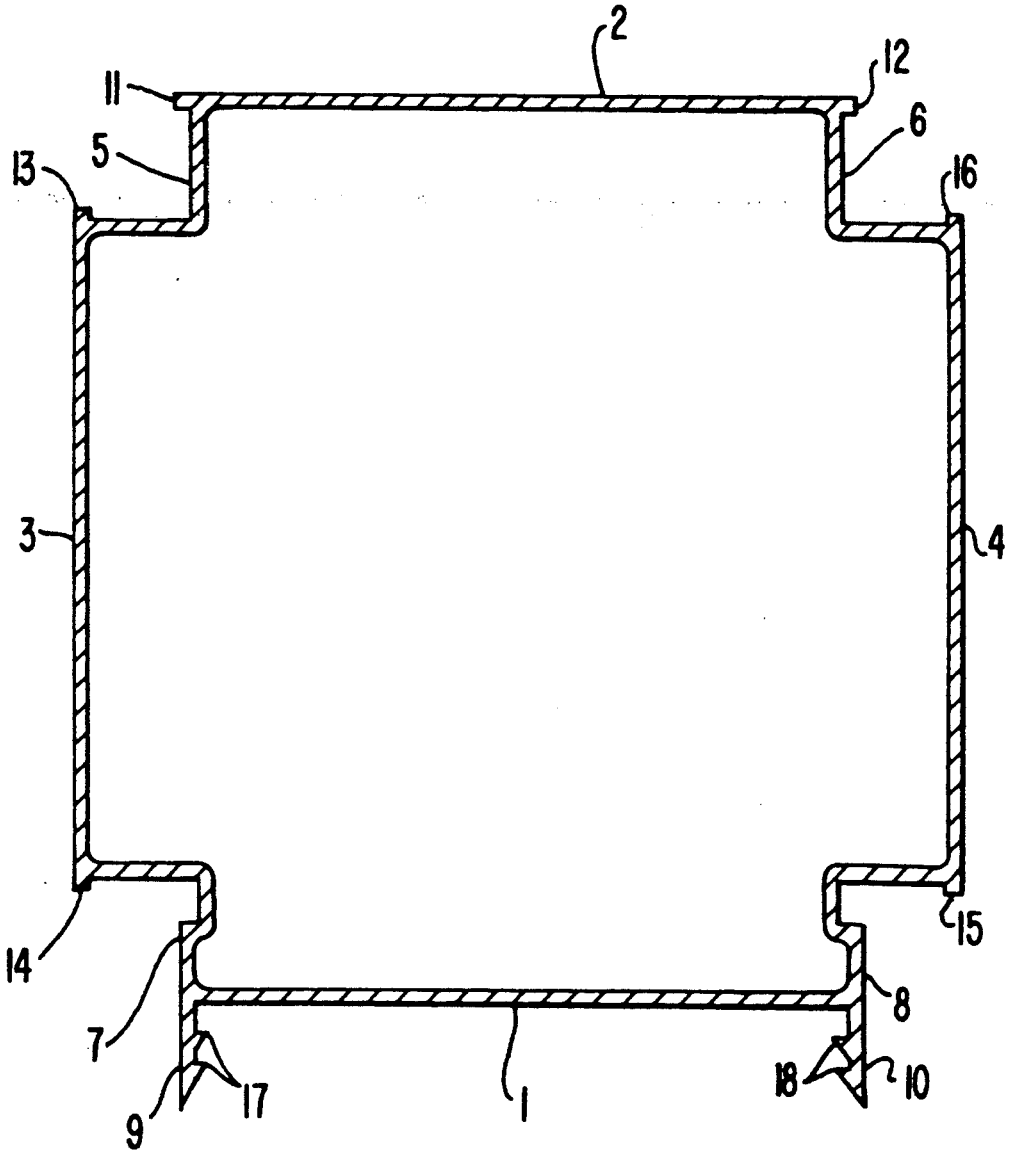
FIG. 2 shows a cross-section through a structural element according to another embodiment of the present invention.

In the embodiment illustrated in FIG. 2, there are provided, on the edges of the sides 2, 3 and 4, short flanges 11–16 which lengthen the sides, flanges 11 and 12 on side 2, flanges 13 and 14 on side 3, and flanges 15 and 16 on side 4. These short flanges 11–16, lengthening the sides, are intended to cooperate with snap catches 17, on the inside of the flange 9, and 18, on the inside of the flange 10, as is illustrated more closely in FIG. 3. Since there are provided, on the inside of the two flanges 9 and 10, double snap catches 17 and 18, the possibility is created of a certain angular inclination of the mutually interconnected structural elements or profiles according to the present invention. Moreover, the symmetry in the design of the structural element or profile further permits the construction of both T-joints and complete intersections. However, it has proved possible to dispense with the snap catches 17, 18, as is apparent from FIG. 1.

Figure 3:
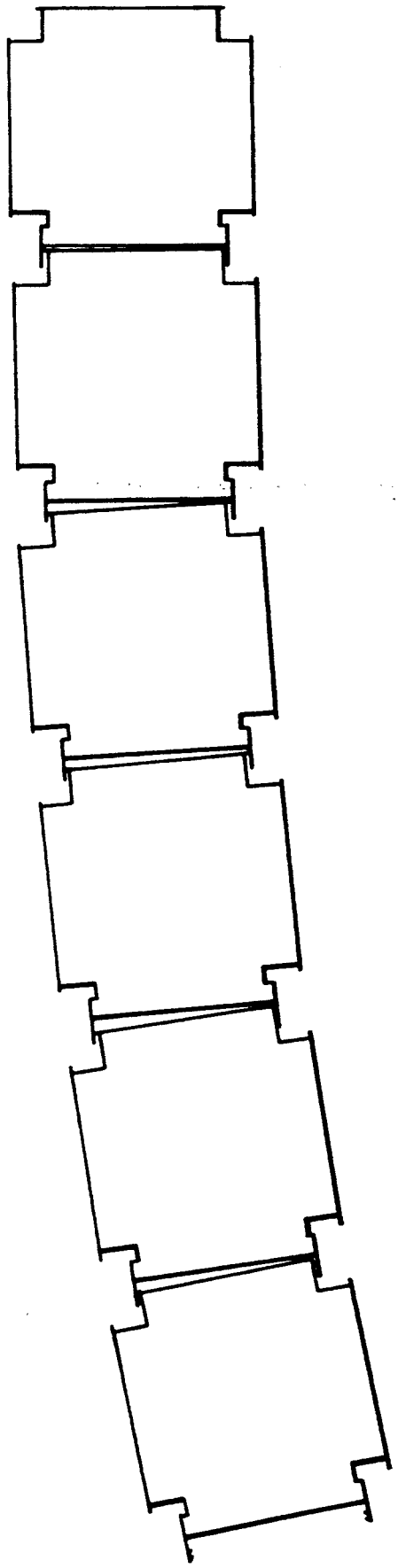
FIG. 3 shows a cross-section through a number of combined structural elements according to the present invention.

For anchoring a hoarding or screeen constructed from a number of profiles or structural elements according to FIGS. 1–3, use is made of rigidifying tubes or posts is suitable spaced-apart relationship, the diameter of the posts being adapted to the interior of the profile.

FIG. 3 exemplifies the pivotability in interconnecting of a plurality of profiles or structural elements according to the present invention. The flanges 9 and 10 will obviously be capable of resting against the corner walls, whereby the joint between two profiles or elements will be fully tight, at least as regards noise. The snap catches 17 and 18 on the flanges 9 and 10, and the flanges 11–16 on the sides 2, 3, and 4 permit angular inclination of the profiles in relation to one another without, to this end, the joint between two profiles or elements being open. This may be desirable for providing either an arcuate screen or other lighting effects or the like when the profiles are wholly or partly translucent and/or transparent. As has been mentioned earlier, it is possible to dispense with the snap catches 17, 18 and the flanges 11–16 without any injurious effects on design and construction or the desired effect.

As has been mentioned above, the apparatus according to the present invention makes possible an extremely high degree of versatility in the erection of a screen partition or noise barrier. For example, the rigidifying posts 23 may be provided at the top with suitable light fittings for achieving an effectful illumination of the erected screen partition or noise barrier and its immediate surroundings. Similarly, it has proved appropriate to mount the profiles on movable concrete foundations.

Figure 5:
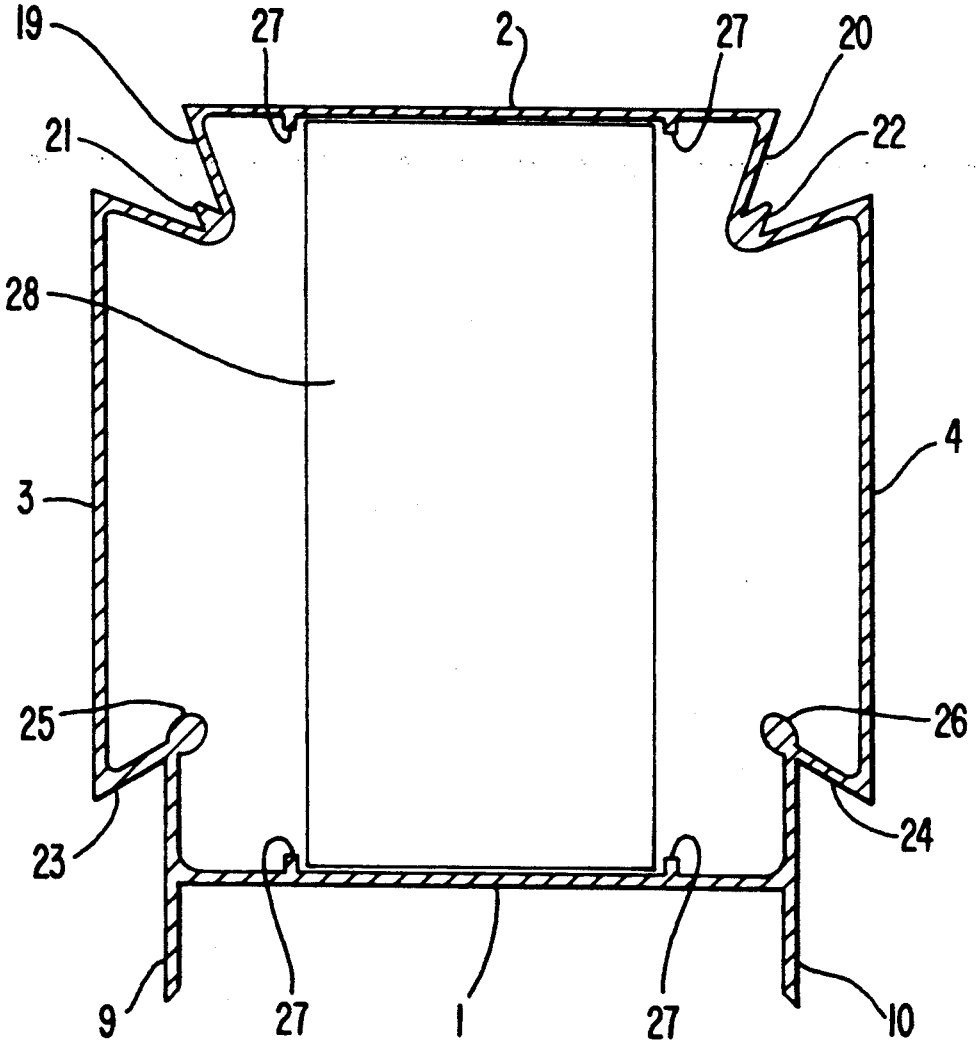
FIG. 5 shows a cross-section through a profile according to a further embodiment of the present invention.

FIG. 5 shows a further embodiment of the present invention. The profile is substantially quadrilateral and has two opposing sides or surfaces 1 and 2 and two opposing sides or surfaces 3 and 4 at right angles thereto. The two corners 19 and 20 located on either side of the surface 2 are indented into the profile and give the side 2 the form of a dovetail. At the bottom of each of the corners 5 and 6, is disposed a material gathering 21 and 22, respectively, for forming supports for a flange which will be described in greater detail below. On the opposing side or surface 1, there is provided a flange 9 along the one edge of the side or surface 1 and a flange 10 along the other edge of the side or surface 1. The corners 23, 24 disposed on either side of the side or surface 1 are also indented in to the interior of the profile, and material gatherings 25 and 26, respectively, are also provided in the corners 23 and 24 but, in these corners 23, 24 the material gatherings 25 and 26 are on the inside of the profile, as opposed to the material gatherings 21, and 22 in the corners 19 and 20. The opposing sides or surfaces 3 and 4 will also, as a result of the corner indentations, be given the form of a dovetail, whereby interconnection with other identical profiles is greatly facilitated.

On the inside of each of the surfaces or sides 1 and 2, there are disposed two spaced-apart projections 27. In order to impart to the profile an additional noise damping effect, the interior of the profile may be wholly or partly filled with a suitable ballast material. In the embodiment illustrated in FIG. 5, the ballast material consists of a lightweight concrete beam 28 whose thickness corresponds to the distance between the projections 27 and whose length is somewhat greater than the length of the profile proper, in order that the beam 28 may bottom-out in a lower U-beam and possibly also in an upper U-beam 18. The beam 28 provides not only a suitable additional weight, but also a suitable rigidifying effect. It is also conceivable to employ other types of ballast material, for example sand, gravel, stone, water etc., whereby it will be possible to achieve sweeping and versatile effects in combination with wholly or partly transparent materials in the profile.

We claim:

1. A structural element for use in constructing a continuous surface, such as a screen, a noise barrier, a partition, or the like, said structural element comprising:

first and second parallel opposing surface members;

third and fourth parallel opposing surface members; and first, second, third, and fourth reversed corner members joining said first, second, third, and fourth surface members to form a substantially quadrilateral hollow member having reversed corners indented into the quadrilateral member, with said first and second surface members substantially at right angles to said third and fourth surface members, the corner members adjacent said first surface member extending beyond said first surface member in a direction away from said hollow member to form a pair of connecting flanges spaced apart by a distance substantially equal to the length of one of said surface members, between the reversed corners adjacent thereto, permitting the connecting flanges to fit over a surface member of an identical structural element and into the reversed corners adjacent such surface member to join the structural elements together.

2. A structural element as claimed in claim 1, wherein the depth of each of the reversed corners is substantially equal to or greater than the length of the connecting flanges.

3. A structural element as claimed in claim 2, further comprising an extension flange extending from each end of each of said second, third, and fourth surface members, and a snap catch device on each of the connecting flanges and adapted to cooperate with said extension flanges to permit said structural element to be secured to an identical structural element.

* * * * *